US007770574B1

(12) United States Patent
Ferreira

(10) Patent No.: US 7,770,574 B1
(45) Date of Patent: Aug. 10, 2010

(54) WHEELED GUIDE ASSEMBLY FOR USE WITH CUT PROVIDING TOOLS

(76) Inventor: Americo D. Ferreira, 23 Duvall Dr., Hampton Bays, NY (US) 11946

( * ) Notice: Subject to any disclaimer, the term of this patent is extended or adjusted under 35 U.S.C. 154(b) by 558 days.

(21) Appl. No.: 11/829,981

(22) Filed: Jul. 30, 2007

Related U.S. Application Data

(60) Provisional application No. 60/918,221, filed on Mar. 15, 2007.

(51) Int. Cl.
*B28D 1/04* (2006.01)

(52) U.S. Cl. ..... 125/13.01; 83/523; 172/17; 299/39.3

(58) Field of Classification Search ..... 280/809, 280/87.042; 125/13.01, 12; 56/17.5; 299/39.3; 172/17; 83/523
See application file for complete search history.

(56) References Cited

U.S. PATENT DOCUMENTS

| | | | | | |
|---|---|---|---|---|---|
| 2,673,725 | A | * | 3/1954 | Coates | 299/39.3 |
| 4,182,100 | A | * | 1/1980 | Letter | 56/16.7 |
| 4,310,198 | A | * | 1/1982 | Destree | 299/39.3 |
| 4,688,376 | A | * | 8/1987 | Wolfe, Sr. | 56/16.7 |
| 4,704,849 | A | * | 11/1987 | Gilbert et al. | 56/17.5 |
| 4,928,662 | A | | 5/1990 | Chiuminatta et al. | |
| 4,938,201 | A | | 7/1990 | Chiuminatta et al. | |
| 5,540,210 | A | | 7/1996 | Jones | |
| 5,669,371 | A | | 9/1997 | Rupprecht et al. | |
| 5,970,694 | A | * | 10/1999 | Knox, Jr. | 56/16.7 |
| 6,009,695 | A | * | 1/2000 | Karas | 56/237 |
| 6,109,625 | A | | 8/2000 | Hewitt | |
| 6,349,712 | B1 | | 2/2002 | Halstead | |
| 6,568,088 | B1 | | 5/2003 | Ende | |
| 2005/0172946 | A1 | | 8/2005 | Markley | |
| 2006/0157045 | A1 | | 7/2006 | Galambos et al. | |

OTHER PUBLICATIONS

Engrave-A-Crete, Inc.; Manasota Industrial Park; 4693—19th Street Court East; Bradenton, FL 34203 USA Website product information for "Mongoose-411" (http://www.engraveacrete.com/catalog/mongoose411.php) Submitted as NPO .pdf document.

* cited by examiner

*Primary Examiner*—Timothy V Eley
(74) *Attorney, Agent, or Firm*—Island Patent; F. Scott Tierno

(57) ABSTRACT

A wheeled guide assembly for use with cut providing tools includes a base portion having a first end and a second end, and rockable between either of a first position, enabling straight-line cuts to be made, and a second position enabling controlled curved-line cuts. The base portion includes a plurality of wheels, with at least two pivot wheels, at least one fixed wheel, and at least one steerable wheel provided. The wheels are rollably coupled to the base portion and or a housing of the cut providing tool, such that the cut providing tool may be readily and easily rocked by the user into either the first position or the second position, as needed. This abstract is provided to comply with rules requiring an abstract, and is submitted with the intention that it will not be used to interpret or limit the scope and meaning of the claims.

20 Claims, 10 Drawing Sheets

FIG. 6B
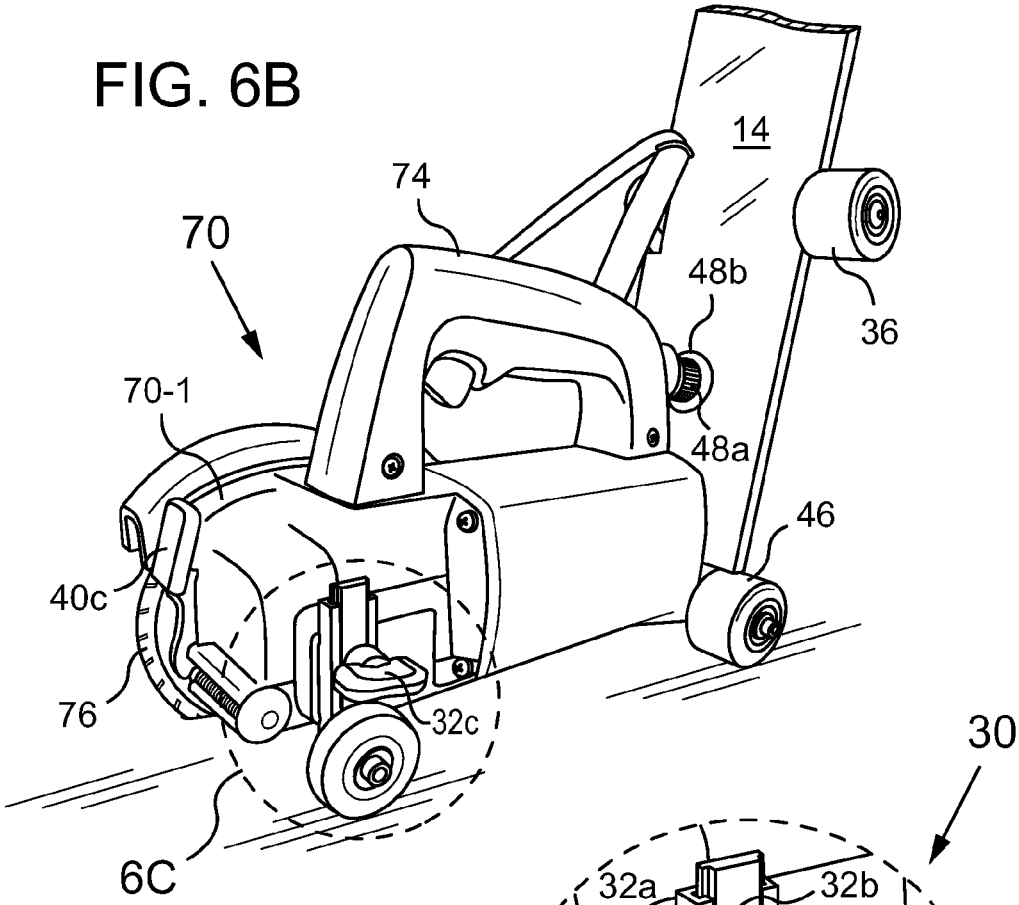
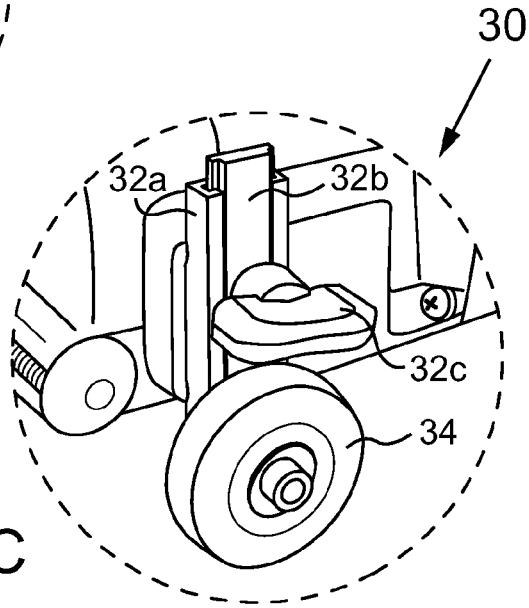
FIG. 6C

WHEELED GUIDE ASSEMBLY FOR USE WITH CUT PROVIDING TOOLS

CROSS REFERENCE TO RELATED APPLICATION

The subject matter contained herein claims priority from the commonly owned U.S. provisional patent application Ser. No. 60/918,221 filed on Mar. 15, 2007, which is hereby incorporated by reference.

TECHNICAL FIELD

The presently disclosed invention relates most generally to wheeled structures and assemblies for use with cut providing (preferably power) tools. More particularly, the present invention relates to a wheeled guide assembly for use with cut providing tools by coupling thereto, or by incorporation into a portion of a housing. The wheeled guide assembly, when included with a cut providing tool, enables an operator to selectively produce substantially straight-line cuts or curved-line cuts, upon a selected surface.

BACKGROUND

One technique for providing surfaces such as driveways, walkways, sidewalks, patios, etc., is to employ mixed concrete. Somewhat recently, there has been a desire to "dress up" these concrete surfaces, especially when employed along with, or adjacent to, brick and paver surfaces. A general well known term for this dressed up concrete product is "decorative concrete". One common decorative concrete technique is to provide partial or fully through "cuts" in the surface of the concrete—either after minimal curing and hardening, or more often after substantial hardening/curing has occurred. As minimally cured material is easier to damage, and provides other limitations, there is a preference to apply functional and decorative finishing accents (e.g., cuts and grooves) after substantial hardening and curing has occurred.

Accordingly, skilled concrete artisans employ cut providing tools, such as specialized small sized circular saws for a variety of cutting needs. A portion of the required cuts may include finishing cuts, such as score cuts, expansion cuts, and trim cuts. Other needed cuts may be decorative and intermediate cuts (as needed for inlay work). Many if not all of these cuts may be termed 'precision cuts' in that they must be made as close to a desired cutting line and location as possible. In addition, many of these cuts have a preferred 'depth of cut', some possibly shallow, and some possibly deep or through. It may be noted that shallow or partial cuts may also be termed 'grooves'.

As appreciated by skilled persons, there is often a further need to provide straight-line cuts, as well as curved-line cuts. Most preferably it would be desirable to have a cutting, routing, or grinding means that would enable both straight-line and curved-line cuts to be selectively and readily provided, as required, using a simple low-cost structure. Accordingly, there is a need for an improved, easy-to-use, highly portable, wheeled guide means that may be suitably coupled to, placed under, or formed as a portion of, a cut providing tool such as a circular saw, a reciprocating saw, etc., enabling an operator to selectively roll the tool upon included rollably couple wheels for making either straight-line cuts and curved-line cuts, as desired. Most preferably the structure will support a switching from one type of cut (e.g., straight) to another (e.g., curved) with a simple and rapid motion/action. A number of other characteristics, advantages, and or associated novel features of the present invention, will become clear from the description and figures provided herein. Attention is called to the fact, however, that the drawings are illustrative only. In particular, the embodiments included and described, have been chosen in order to best explain the principles, features, and characteristics of the invention, and its practical application, to thereby enable skilled persons to best utilize the invention and a wide variety of embodiments providable that are based on these principles, features, and characteristics. Accordingly, all equivalent variations possible are contemplated as being part of the invention, limited only by the scope of the appended claims.

SUMMARY OF PREFERRED EMBODIMENTS

In accordance with the present invention, a wheeled guide assembly is adaptable for use with items such as cut providing tools, including circular saws, reciprocating and jig saws, routers, etc. The wheeled guide assembly includes a base portion having a first end and a second end. The base portion may most preferably be provided, at least in part, by a flattened and rigid member, which is arranged with a plurality of wheels rollably mounted thereto. Importantly, the base portion of the wheeled guide assembly is also 'rockable', due to the positioning of the rollably coupled wheels, and arranged for being maintainable in either a first (rolling) position, enabling substantially straight-line motion and cuts, and a second (rolling) position supporting controlled curved-line motion and cuts.

A plurality of spaced and rollably coupled wheels are provided with preferred embodiments of the wheeled guide assembly. Included are at least two pivot wheels, which are axially aligned and preferably mounted (and spaced) on or extending from opposite sides of the base portion. The pivot wheels will typically be located with a rolling axle or axis transversely positioned across the base portion, at a selected location between the first end and the second end (of the base portion). It may be noted that an axle or axis may also be termed a 'horizontal rolling axle'.

In addition to the pivot wheels, at least one fixed wheel is rollably coupled to one end of the base portion. The fixed wheel or wheels may also be termed 'fixed direction wheels'. Collectively, the fixed (direction) wheels and the (fixed direction) pivot wheels, when employed for rolling purposes, encourage and support straight-line motion, and therefore enable straight-line cutting with a properly configured cut providing tool coupled to or formed with the wheeled guide assembly.

Preferred embodiments also typically include at least one steerable, rollably mounted wheel, which is rotatably coupled to the base portion at an end opposite to the end that the fixed wheels are located. The rotatable coupling of the steerable wheel is structured for enabling an operator to rotate the steerable wheel about a vertical axis, for making operator controlled curved-line cuts having selected and or variable radii. Importantly, the steerable wheel is arranged for engaging and rolling upon a surface being cut such that an operator may selectively alter an angle between a longitudinal axis of the base portion and the rolling direction of the wheeled guide assembly. As will be discussed in greater detail hereinafter, the steerable wheel(s), in combination with the pivot wheels, may be employed for curved-line rolling such that an operator may make curved-line cuts, possibly in a dynamic manner with varying curvatures and radii (e.g., free hand cutting).

To enable consistent cuts having as uniform a cut width as possible, a most preferred embodiment of the wheeled guide assembly may be arranged such that a horizontal rolling axle (or axis) of the pivot wheels is vertically aligned with a cutting member of the cut providing tool. For example, as illustrated herein, when the cut providing tool is a circular saw, a rotational axis of a cutting member shaft 76*a* of the cut providing tool is preferably vertically aligned with (and located above) the rolling axis of the pivot wheels. If the cut providing tool were a jig-saw or saber saw, a vertical cutting axis of a cutting member may pass (vertically) through the rolling axle or axis of the pivot wheels. Accordingly, it must be noted that the vertical alignment arrangement, wherein the pivot wheels and the selected cutting member sharing a vertical alignment axis (VAA), provides for the making curved-line cuts, having a minimized additional cut width (when compared with straight-line cuts). To the extent possible the structure of the wheeled guide assembly has been selected with a goal of providing (relatively) consistent width cuts, whether they are curved-line cuts or straight-line cuts.

Another aspect of the wheeled guide assembly of the present invention, which may be provided with preferred embodiments, includes a rotatable coupling of the cut providing tool to the base portion. The rotatable coupling may be best provided at the end at which the fixed wheels are also mounted. The rotatable coupling enables the base portion to be rotated substantially 270 degrees about the rotatable coupling (with respect to the housing of the cut providing tool), so as to position the base portion substantially behind the cut providing tool. When in this rotated position, which may be termed a 'stowed position', the base portion and an attached steering mechanism may be securable in the illustrated out-of-the-way (stowed) position. When the base portion is stowed an operator may make substantially closer cuts when approaching an obstruction, such as a wall, staircase, fixed partition, half wall, raised planters, etc.

BRIEF DESCRIPTION OF THE DRAWINGS

In the drawings, like elements are assigned like reference numerals. The drawings are not necessarily to scale, with the emphasis instead placed upon the principles and features of the present invention. Additionally, each of the embodiments depicted are but one of a number of possible arrangements utilizing the fundamental concepts of the present invention. The drawings are briefly described as follows:

FIG. 6B depicts the invention after the rotatably coupled wheeled guide assembly has been rotated approximately another 180 degrees from its position of FIG. 6A, placing the wheeled guide assembly in a stowed position, behind the cut providing tool.

FIG. 6C provides an enlarged view of a drop wheel assembly of FIG. 6B, including a T-channel portion preferably mountable upon a lower front portion of the cut providing tool in a substantially vertical orientation, and structured for accepting a T-bar member with a drop wheel rollably coupled to the T-bar member.

PARTIAL LIST OF REFERENCE NUMERALS

Figure 1:
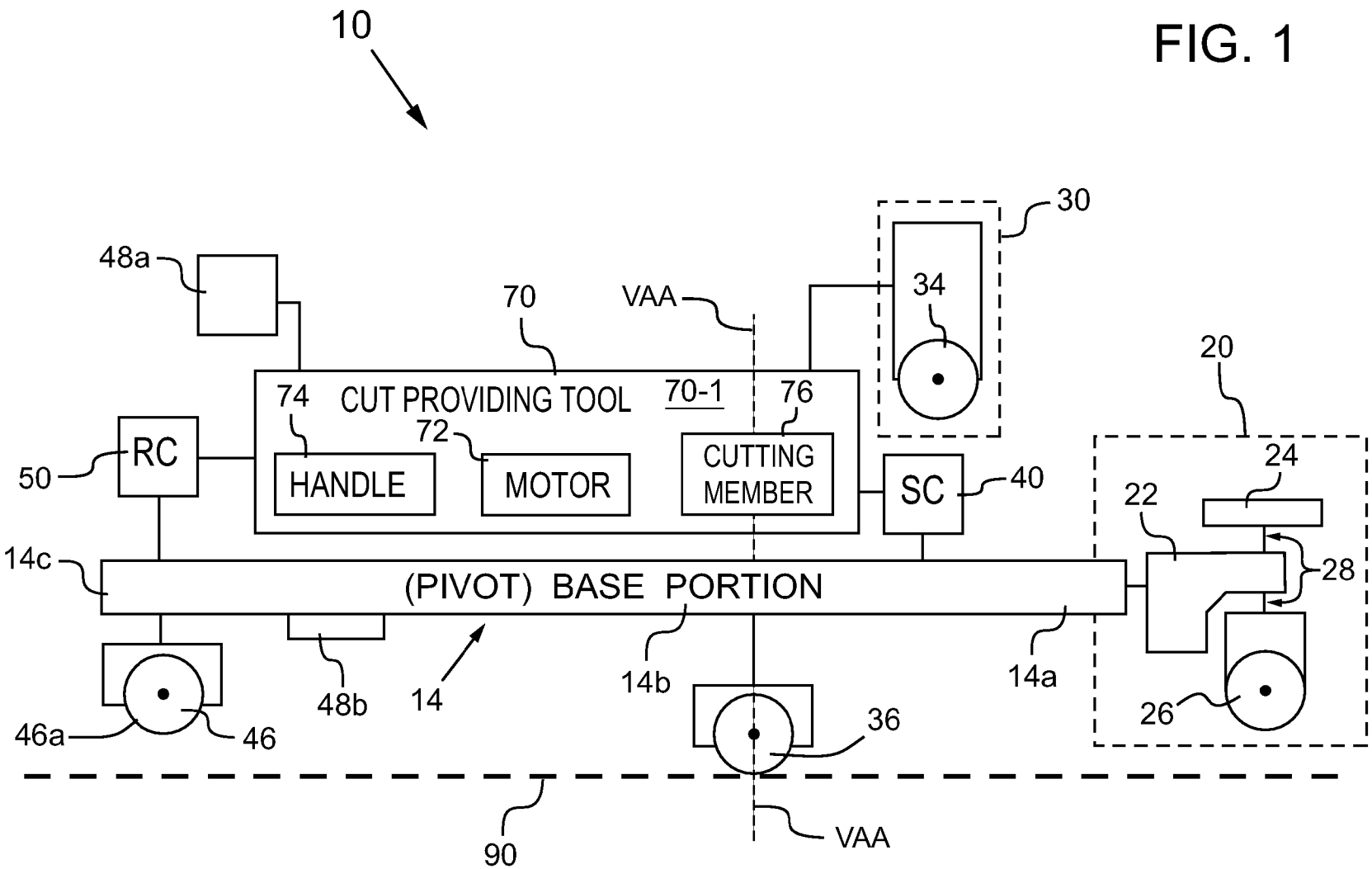
FIG. 1 depicts a high level generalized block diagram of an embodiment of a wheeled guide assembly for use with cut providing tools, in accordance with the present invention.

10,10*a*,10*b*—wheeled guide assembly
14—base portion
14*a*—first end of 14
14*b*—middle location of 14
14*c*—second end of 14
20—steerable wheel assembly
22—support member
24—steering disk
24*a*—detent dimple
25—steering handle
26—steerable wheel(s)
27—(steerable) wheel support portion
28—(vertical) steering shaft
29—spacer
30—drop wheel assembly
32*a*—(elongated) T-channel portion
32*b*—(elongated) T-bar member
32*c*—locking screw knob
34—drop wheel
36—pivot wheels
36*a*—rolling surface (of 36)
38—detent mechanism
38*a*—detent pin
38*b*—detent spring
38*c*—detent threaded plug
39—bore
39*a*—threaded bore
40—(adjustable) slidable coupling
40*a*—u-shaped slide portion
40*c*—slide locking lever
46—fixed wheels
48—latching mechanism
48*a*—first latching portion
48*b*—second latching portion
50—rotatable coupling
60*a*—front cutting alignment guide
60*b*—rear cutting alignment guide

70—cut providing tool
70-1—housing of 70
72—motor
72*a*—rotating shaft (of 72)
74—operator handle
76—cutting member
76*a*—cutting blade
80*a*—straight-line cut
80*b*—curved-line cut
90—surface (being cut)
92—house wall
G1,G2—gap
VAA—vertical alignment axis

DETAILED DESCRIPTION OF EMBODIMENTS OF THE INVENTION

It is important to establish the definition of a number of descriptive terms and expressions that will be used throughout this disclosure. The term 'wheel' will define a round and rolling member upon which a base portion rolls. Each wheel will be understood to be mounted upon an axle so as to rotate or 'roll' about an axis. This axis, which may or may not include an elongated shaft member that may be considered an axle, will be employed to securely mount a respective wheel in a rollable fashion. As such, is should be noted that each wheel of the invention is structured being rollably mounted, and having an outer wheel surface, for rollably contacting a surface to be cut. The term 'cut' is intended to be broadly defined and include any groove, partial or shallow cut, or any straight or curved thru-cut that a cut providing tool that is fixable to, or formed with the present invention, may make upon a selected surface. In addition, cuts according to the invention may be made for finishing, decorative, functional, drainage, as well as other possible purposes. In addition the cuts may be made for any one or more cut producing activates, possibly including 'routing', 'rotational cutting', 'axial cutting', etc. Importantly, the present invention yields an improved cut providing means by enabling cuts to be precisely located, and preferably made having a selected and controlled-depth. The terms 'cut width', 'cut thickness', 'cut span', etc., which are known in the art, may be considered equivalents. As skilled persons will appreciate the cut width is directly related to a cutting or grinding member (e.g., blade thickness, grinding wheel width, router bit diameter, etc.) that actually makes the cut. One aspect of the invention is to specifically provide a cutting arrangement wherein the cut width is uniform (or substantially uniform) regardless of whether the cuts provided are straight-line cuts or curved-line cuts. The term 'obstruction', which is intended to be broadly defined, may include items such as a full or half wall, a partition, a stair riser, a fixed pedestal or floor mounted structure, etc. Importantly, an obstruction may be considered any item up to which, or along which, the present invention may have to effect a cut. Other important terms and definitions will be provided, as they are needed, to properly define the present invention and its associated novel characteristics and features. In addition, the terms and expressions employed herein have been selected in an attempt to provide a full and complete description of the invention. These terms may very well have equivalents known to skilled individuals, which may be long established in the art. As such, the terminology employed has been carefully chosen and is intended for illustration and completeness of description, and may very well have equivalents that are known in the art, but not employed here.

Figure 3:
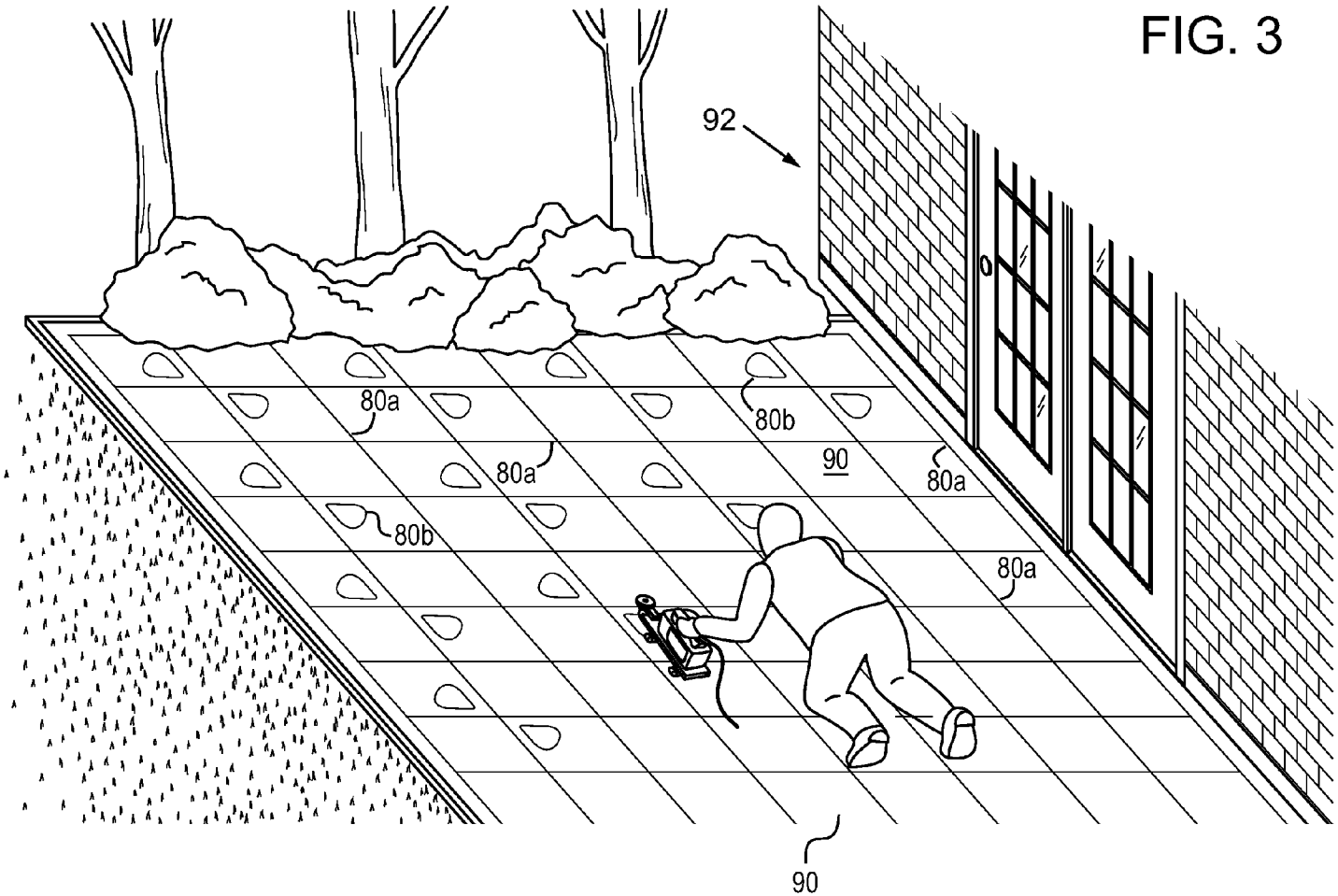
FIG. 3 is a perspective view of an artist's depiction showing one possible cutting pattern that may be applied, for example to a concrete surface, having straight-line and curved-line cuts, which can be made with a cut providing tool equipped with or structured to include the present invention.

Referring now to the drawings, FIG. 1 provides a high level generalized functional block diagram of a wheeled guide assembly of the present invention. As shown, the wheeled guide assembly 10, which may function as an improved rollable support carrier for a cut providing tool, enables the cut providing tool 70 to be employed for making one or more cuts. For example, as shown in FIG. 3, cuts 80*a*/80*b* may be made in a selected and typically hard surface 90. The wheeled guide assembly 10 depicted in FIG. 1 includes a (pivot) base portion 14 having a first end 14*a*, a middle portion or location 14*b*, and a second end 14*c*. The base portion 14 is arranged to be 'rocked' upon one or more included pivot wheels 36. As such, when in a first (rolling) position, say when rolling on the pivot wheel(s) 36 and at least one (directional) fixed wheel 46, the wheeled guide assembly 10 will encourage and or support a straight-line rolling motion, and thereby encourage and support straight-line cutting. Similarly, when rocked into a second (rolling) position, say when rolling upon the pivot wheels 36 and at least one steerable wheel 26, the wheeled guide assembly 10 may encourage and or support a 'curved-line' rolling motion, and thereby encourage and support curve-line cutting. It may be noted that when in the second position, if the steerable wheel 26 is properly adjusted (e.g., rotated about a vertical steering shaft 28), straight-line cutting may be supported—even when in the second position. However, it is contemplated that straight-line cutting will generally be conducted in the first position.

As appreciated by skilled persons when the pivot wheels are axially coupled to the base portion, such that an outer rolling surface 36*a* of the pivot wheels 36 extends below, and at least partially through, a plane established by considering only a plurality of rolling surfaces of the fixed wheels and the steerable wheel(s). This arrangement is clearly shown in FIG. 1, wherein the rolling surface 36*a* of each pivot wheel 36 is depicted contacting a surface 90, while each of the fixed wheels 46 and steerable wheel 26 is not contacting the surface 90.

As further illustrated in FIG. 1, a steerable wheel assembly 20, which may also be termed a 'steering mechanism', is provided configured with a single steerable wheel 26. As depicted, one possible structure may included is a support member 22, which is fixed or removably fixable to the base portion 14. In addition, a steering shaft 28 may be included and rotatably coupled to the support member 22 proximate to a distal end portion. A steering disk 24 may be included for grasping by an operator and selectively rotated to adjust the amount of curvature provided by rolling and cutting activities. Clearly, an operator may be cutting while also rotating the steerable wheel 26 (with the grasped steering disk 24) to alter a radius of a cut being made.

Turning again to FIG. 1, when considering a typical cut providing tool 70, at least one operator handle 74. For the purposes of this invention, when cut providing tools are mated with a wheeled guide assembly 10/10*a*, a motor 72 will be assumed to be incorporated into a housing 70-1 of the cut providing tool 70. The motor 72 may be powered from any available power source, such as batteries, a generator, or a line-power source. Importantly, the motor 72 is coupled to a cutting member 76, such as a cutting blade 76*a* (FIG. 2A), router bit, grinding disk, etc.

It must be noted that the present invention may be provided as a primarily separate structure that is adapted for use with an existing cut providing tool 70, or alternately provided as an integral portion of a housing structure of a cut providing tool (not explicitly illustrated). In each case one or more couplings may be provided, if needed, between the base portion 14 and the cut providing tool 70. For example, as shown in the block diagram of FIG. 1, and more fully discussed hereinafter, a rotatable coupling 50 (RC) and an (adjustable and lockable) slidable coupling 40 (SC) may most preferably be included with the wheeled guide assembly 10 of the invention. At minimum, the rotatable coupling 50 works in conjunction with the slidable coupling 40 for enabling a distance between the base portion 14 and the cutting member 76 to be adjusted so that the 'depth-of-cut' can be set as required. In their conventional states, certain rotatable couplings 50 and slidable couplings 40 are known to skilled persons. In the case of the present invention, one or more modified rotatable couplings 50 and or slidable couplings 40 may be included for supporting additional functions and features, as will be fully discussed hereinafter when referring to FIGS. 6A, 6B, and 6C.

Returning again to FIG. 1, an additional structure may be included with embodiments of the invention. When the wheeled guide assembly 10 and cut providing tool 70 are properly coupled, a slidably adjustable drop wheel assembly 30 may be included with the invention. The drop wheel assembly 30 enables embodiments of the wheeled guide assembly 10 to be (temporarily) reconfigured for providing much cuts closer to an obstruction then is possible when the wheeled guide assembly 10 is in a 'standard operating position', as shown in FIGS. 1 through 4B. A most preferred drop wheel assembly 30 will be fully presented when discussing FIGS. 6B and 6C.

Figure 2A:
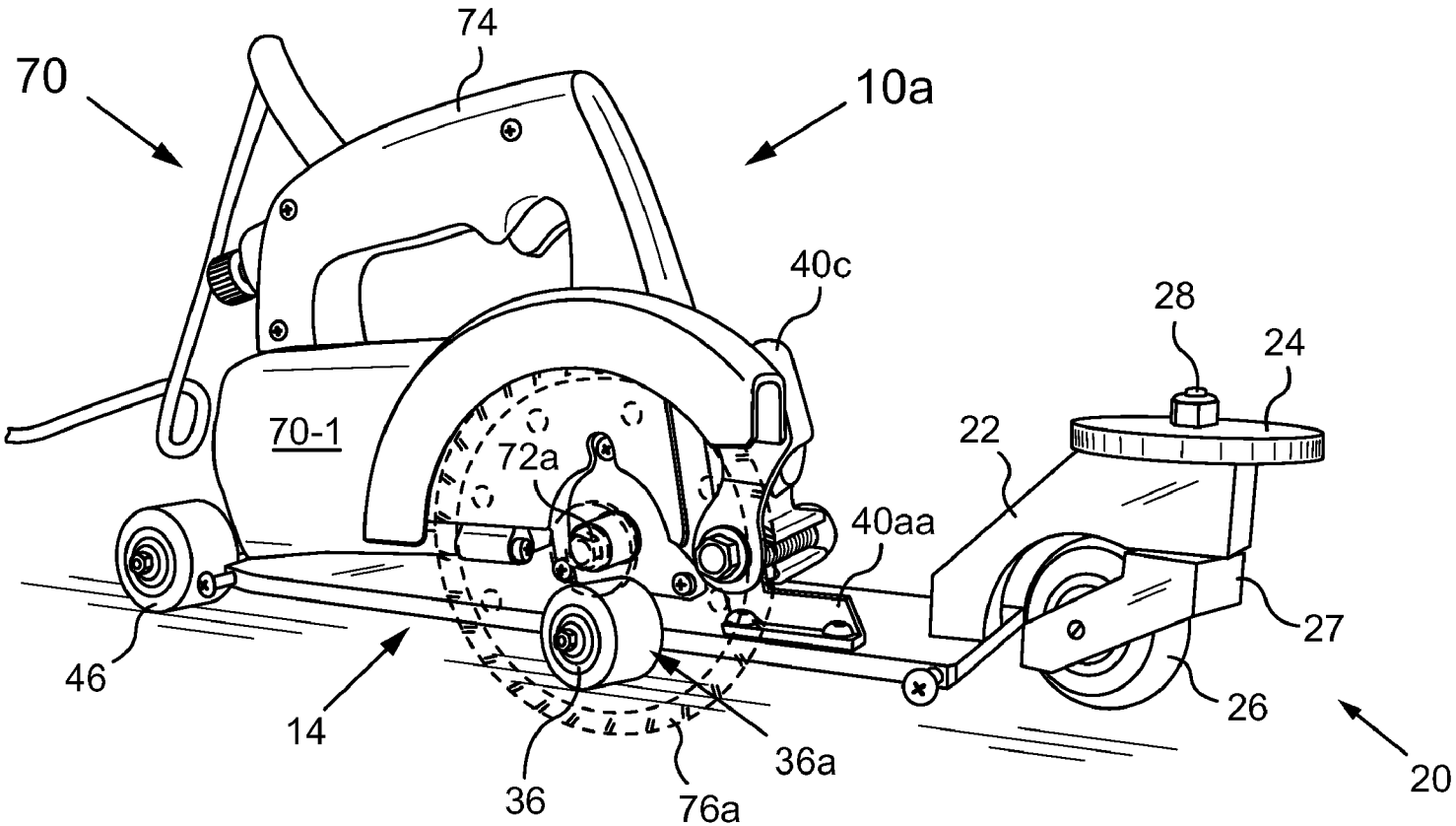
FIG. 2A provides a perspective side view of a first possible embodiment of a wheeled guide assembly of the invention configured with a cut providing tool in the form of a circular saw.
Figure 2B:
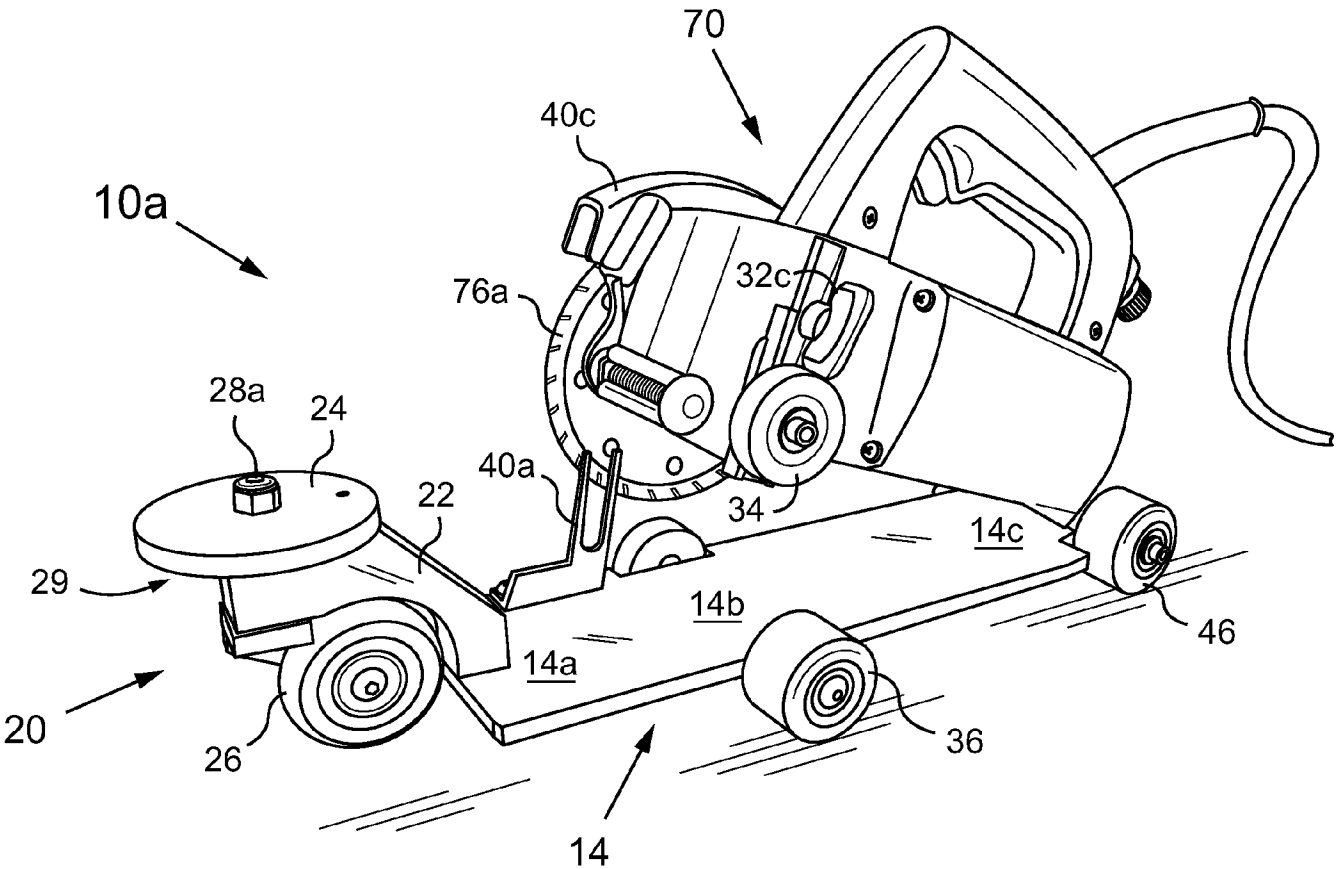
FIG. 2B shows a reverse perspective view of the wheeled guide assembly of FIG. 2A, depicted with a slidable coupling unlocked and detached, enabling a rotatably coupled cut providing tool to be lifted and rotated away from the clearly shown wheeled base portion.

Turning now to FIGS. 2A and 2B, a first possibly preferred embodiment of a wheeled guide assembly 10*a* is depicted with a base portion 14 provided having a substantially rigid and flattened plate structure. Other base portions 14 are certainly providable that may not be so simple, flat, and or low-cost. As can be seen, a plurality of rollably coupled wheels are mounted to the base portion 14, including at least one steerable wheel 26, a preferable plurality of pivot wheels 36, and at least one fixed wheel 46. The pivot wheels 36 may be axially aligned and mounted on opposite sides of the base portion 14, at a selected middle location 14*b*, which is clearly located between the first end 14*a* and the second end 14*c* of the base portion 14.

As further shown in FIGS. 2A and 2B, the fixed wheels 46 and the steerable wheel 26 are mounted on opposite ends of the base portion 14. Preferably (but not necessarily) the steerable wheel 26 is fixed at a first and front end, which is the end that typically leads when making cuts. The steerable wheel 26 is coupled to the base portion by way of a support member 22, with a first end 22*a* of the support member 22 fixable at the selected end of the base portion 14, which a front end as illustrated. Importantly, the steerable wheel 26 is preferably located at an opposite end to where the fixed (rollably mounted) wheels 46 are coupled to the base portion 14.

As depicted in FIG. 3, an operator can make straight-line cuts 80*a* and curved-line cuts 80*b*, in order to functionally or decoratively finish a preferably hard and possibly poured flooring surface. As shown, the operator has already made a large number of cuts, including straight-line cuts 80*a* provided in a grid-like pattern, and curved-line cuts 80*b* that are depicted as curved and closed decorative shapes.

Figure 4A:
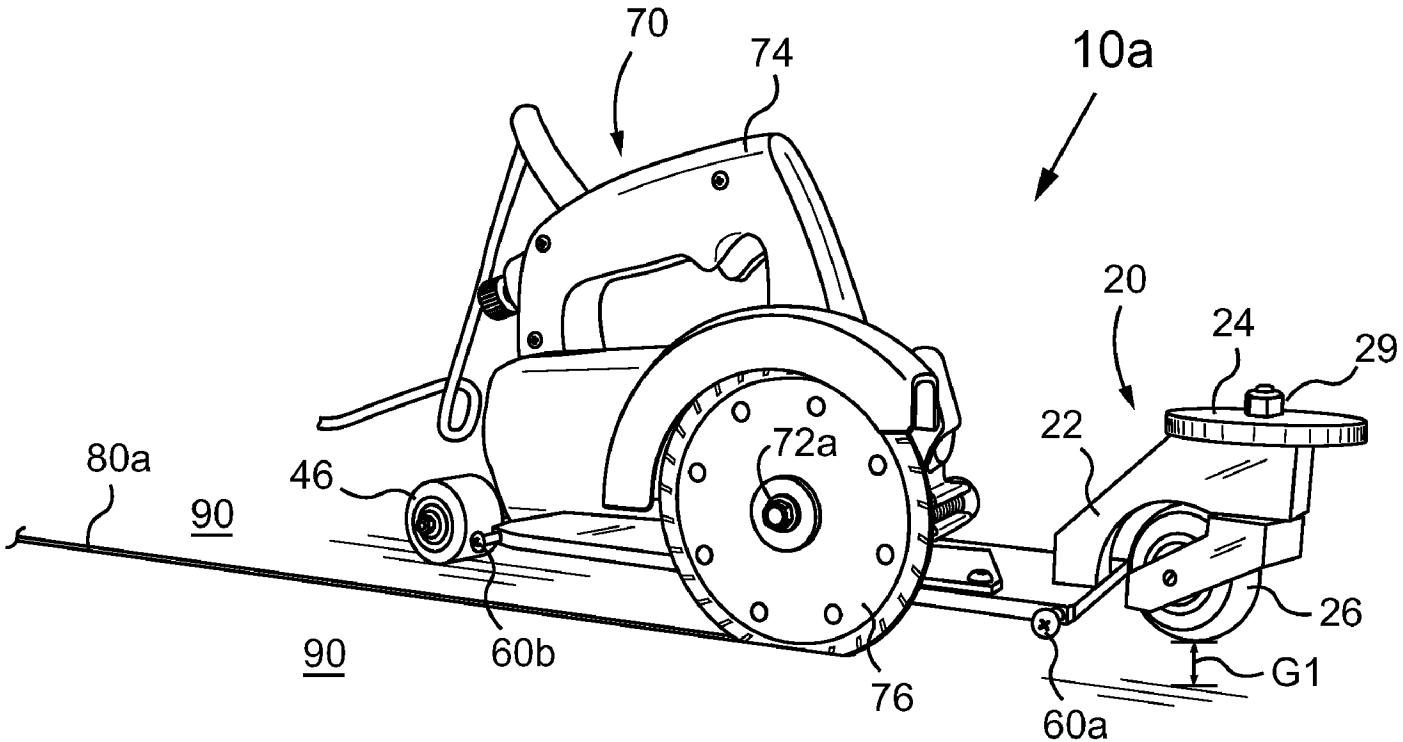
FIG. 4A provides a perspective view of the wheeled guide assembly and a cut providing tool coupled thereto, rocked into a first position and making a substantially straight-line cut.

When considering the operation of the embodiment depicted in FIGS. 2A and 2B, to cause straight-line cutting activities to occur the base portion 14 is placed or rocked into a first (rolling/cutting) position. When rocked into this first position the wheeled guide assembly 10/10*a* rolls upon the pivot wheels 36 and the rear mounted fixed wheels 46. As shown in FIG. 4A, when maintained in the first position, and making straight-line cuts 80*a*, there will be a gap G1 between the surface 90 and the non-contacting steerable wheel 26. With gap G1 substantially maintained, there is an encouraging of a substantially straight-line motion by rolling upon the pivot wheels 36 and the fixed wheel(s) 46. Clearly the straight-line motion will enable substantially straight-line cuts 80*a* to be made with the cut providing tool 70 and wheeled guide assembly 10*a*.

Figure 4B:
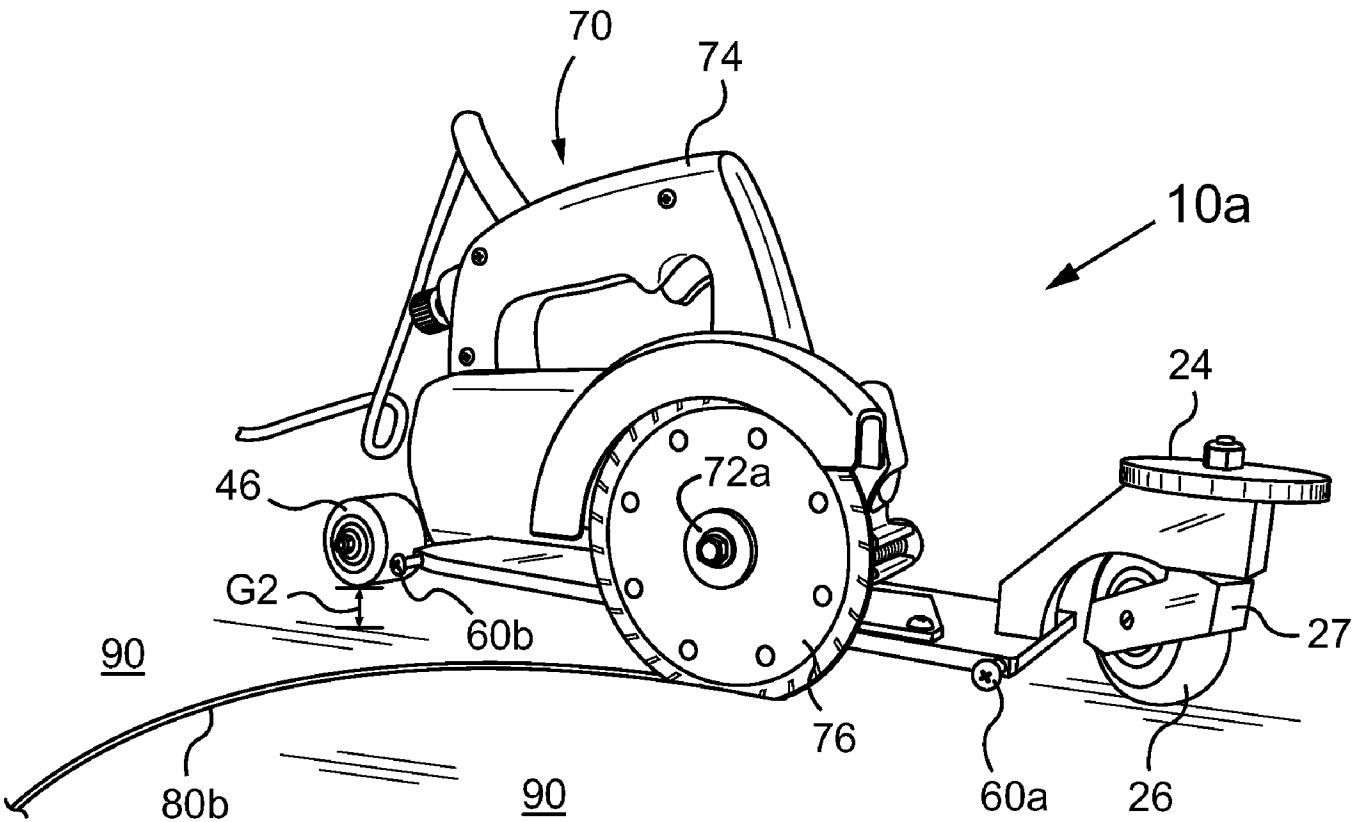
FIG. 4B provides a perspective view of the wheeled guide assembly, and cut providing tool coupled thereto, rocked into a second position and making a substantially curved-line cut.

At a point in time when the operator determines that there is a need to stop making a straight-line cut 80*a* (as in FIG. 4A) and begin making a curved-line cut 80*b* (as in FIG. 4B), the operator simply rocks the wheeled guide assembly 10/10*a* (and the cut providing tool 70) into the second position. When in the second position the wheeled guide assembly 10*a* rolls upon the pivot wheels 36 and the at least one steerable wheel 26. In addition, when in the second position (FIG. 4B), the fixed wheels 46 are lifted, establishing a gap G2 between the surface 90 and the fixed wheels 46. Accordingly, as can be seen in FIG. 4B, the second position provides for rolling to be realized upon the pivot wheels 36 and the steerable wheel 26, with the operator able to make controlled and substantially curved-line cuts, possibly in a 'free hand' manner.

When making curved-line cuts by way of the wheeled guide assembly 10/10*a*, it is desirable to provide the curved-line cuts 80*b* having a cut width that is as close as possible to the cut width provided by the straight-line cuts 80*a*. To provide cuts having a substantially uniform width, the most preferred embodiments of the wheeled guide assembly 10/10*a* will include an additional structural limitation in the form of a vertical aligning of a horizontal rolling axis (either actual or effective) of the pivot wheels 36 and a pre-selected, possibly rotating, axis of the cut providing tool 70. For example, as clearly shown in FIG. 2A, a common vertical alignment axis is provided for each of the rotating axis of interest in the form of rotating shaft 72*a* of the cut providing tool 70 and the rolling axis (axle) of the pivot wheels 36. This enables both substantially straight cuts and substantially curved cuts to have a more uniform cut width. In addition, to aid an operator on following a precise cut-path, say along a pre-scribed 'cut-line', additional guide means may be included. For example, as shown in FIG. 4A, at least one of a front cut alignment guide 60*a*, or a rear cut alignment guide 60*b*, may be included. As depicted in FIGS. 4A and 4B, each cut alignment guide may have a flared and flattened end portion. As understood by skilled persons, such aides enable more precise cuts to be made when trying to follow a guide line. For the present invention, guides 60*a* and 60*b* provide alignment aids to an operator for aiding in following a cut-line, or the like, places or drawn upon a surface to be cut.

It must be understood that the cut providing tool 70 need not be the circular saw as illustrated in FIGS. 2A through 4B. If the cut providing tool 70 employed is a jig or saber saw, then the alignment providable with preferred embodiments would be between a rolling axis of the pivot wheels 36 and the linear cutting axis of a cutting blade. This arrangement will again provide more uniform cut widths when making both straight-line cuts and curved-line cuts. Other 'vertical alignments' based on other cutting and other tools/devices will be understood by skilled individuals upon a careful review of this disclosure.

Figure 5A:
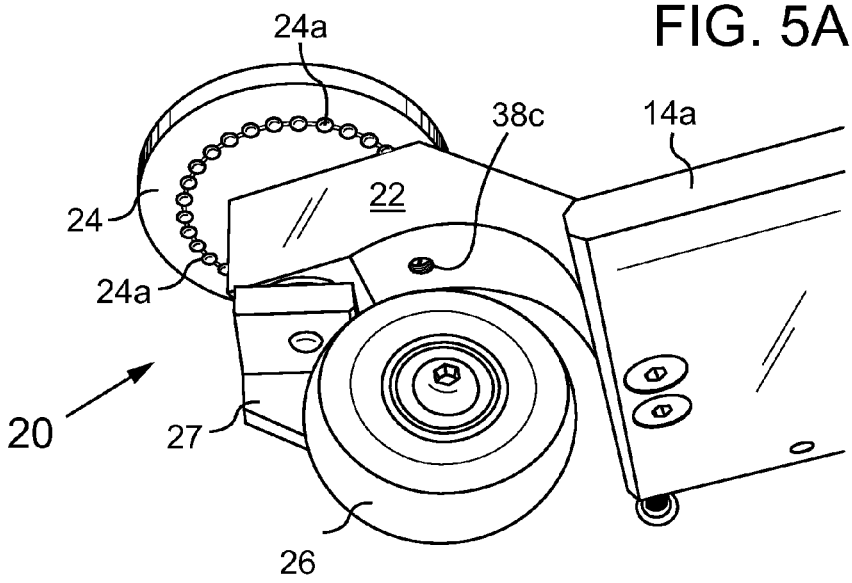
FIGS. 5A and 5B show an enlarged view of one possible embodiment of a steerable wheel assembly useful to either provide curved cuts of a selected radius, as well as providing cuts having varying and or changing radius (e.g., a spiral cut, or a free-hand curved cut).
Figure 5B:
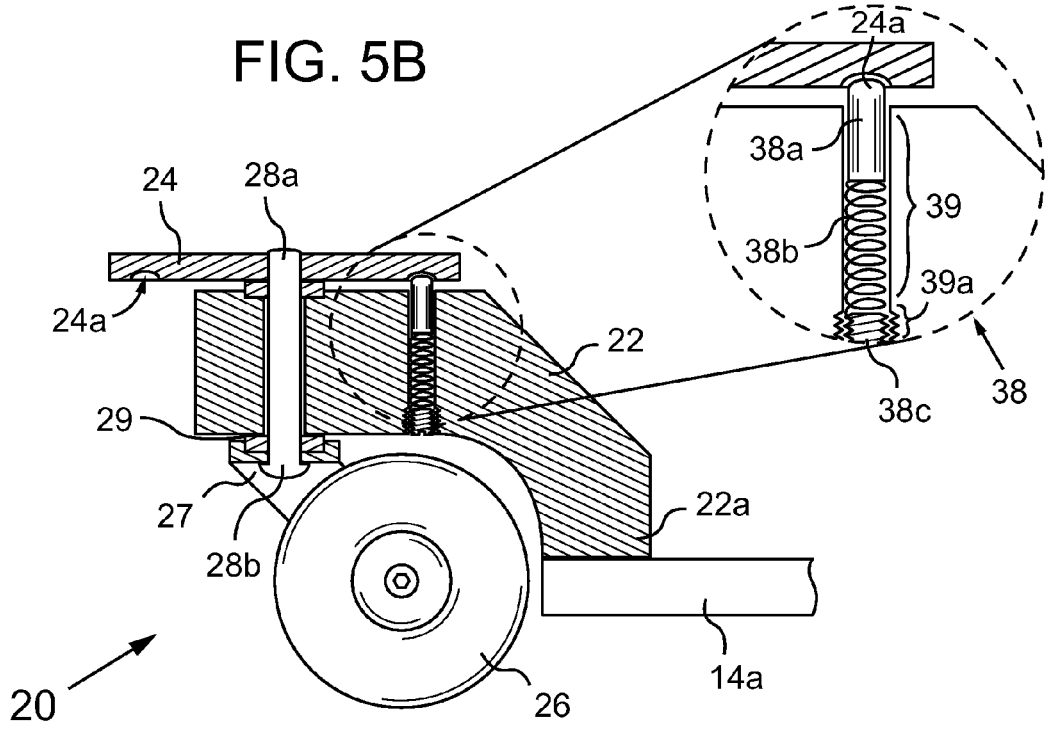

Turning now to FIGS. 5A and 5B, there is illustrated a preferred embodiment steerable wheel assembly 20. The preferred embodiments of the steerable wheel assembly 20 include at least one steerable wheel 26, which is rotatably coupled to the base portion 14. As shown the steerable wheel assembly 20 is coupled to the base portion 14 at an end 14*a*, which is opposite to the end at which the fixed wheels are mounted to the base portion 14. However, it may be noted that the steerable wheel 26 and the entire steerable wheel assembly 20, which may also be termed a 'steering mechanism', may be located at the second end 14*c* (not illustrated), if desirable for a particular structure of the wheeled guide assembly and or cut providing tool.

The steerable wheel assembly 20 is structured to enable an operator to rotate the steerable wheel 26 about a vertical axis. This vertical rotating enables the operator to steer the wheeled guide assembly 10*a* by altering an angle or steering angle of the steerable wheel 26 with respect to the base portion 14. The first embodiment of the steerable wheel assembly 20, as depicted in FIGS. 5A and 5B, includes a support member 22 with a first end 22*a* (of the support member) coupled to the first end 14*a* of the base portion 14. The support member 22 may be provided with a structure that lifts upward and extends outwardly from the end 14*a* of the base portion 14. Also included with the steerable wheel assembly 20 is a vertically oriented steering shaft 28, or an equivalent structure. The steering shaft 28 is preferably rotatably mounted to a distal (possibly upper) end of the support member 22, so that the steering shaft 28 may be rotated about a vertical (longitudinal) axis of the steering shaft 28. As clearly shown, the steerable wheel 26 is fixedly coupled to the lower end 28*b* of the shaft 28. For example, one preferred arrangement couples the steerable wheel 26 to the steering shaft 28 by way of an included wheel support portion 27. The wheel support portion 27 is best seen in FIGS. 2A, 4B, 5A and 5B. As appreciated by skilled individuals, several spacers 29 may be included, proximate to each end of the steering shaft 28, to aid in providing a smoother more consistent and or damped rotation, even when the wheeled guide assembly 10/10*a* is employed during cutting activities.

As illustrated, at an upper end 28*a* of the steering shaft 28 an operator grasping portion may be fixedly provided. For example, the operator grasping portion may be provided by a steering disk 24 of FIGS. 2A, 2B, 5A and 5B, the steering handle 25 of FIG. 7, and other arrangements providable by skilled individuals. It may be noted that the actual structure of any included graspable (steering) portion, may best be determined by the specific material to be cut and the cut providing tool 70 coupled to the wheeled guide assembly 10/10*a*. In addition, it may be noted that in the absence of a grasping portion, or in the absence of the operator grasping the grasping portion, the wheeled guide assembly 10/10*a* of the invention may be employed and operated in a 'freehand' style. When an operator employs a freehand approach, the wheeled guide assembly 10/10*a* may be guided by the operator (while cutting activities are occurring) by the operator directly applying torques and steering forces to one or more grasped handles (of the cut providing tool). This approach enables the operator to firmly hold the cut providing tool 70, or other suitable portions, so as to provide for a controlled freehand cutting of the selected surface 90.

Alternately, when the operator grasping portion is included in one form or another, it may be desirable to have additional structures that enable an angle of the steerable wheel to be either maintained (under reasonable forces) or alternately fixed and locked (once an angle is set or established). As shown best in FIGS. 5A and 5B, one possibly preferred holding and or locking means is illustrated. The depicted embodiment may provide a detent mechanism 38 (see FIG. 5B). Included as a portion of the detent mechanism 38, as clearly seen in the upper left of FIG. 5A, is a series of spaced and equi-radius detent dimples 24*a*. The detent dimples 24*a* may be essentially provided as a ring of shallow holes, as shown. As best seen in FIG. 5B, including the expanded portion, the detent mechanism 38 may include a detent pin 38*a*, which is biased upwardly within a bore 39. The biased detent pin 38*a* engages, in a forcibly releasable fashion, the detent dimples 24*a*. A detent (bias) spring 38*b*, or equivalent structure, may be included for biasing the detent pin 38*a* upwardly in such a way that when a sufficient rotational force (about the vertical axis of the steering shaft) is applied by an operator, the detent pin lowers and causes a compressing of the detent spring 38*b*. The detent spring 38*a* is preferably at least partially compressed by the inclusion of a properly adjusted detent threaded plug 38*c*. The grasping portion may then be rotated until the detent pin 38*a* engages and settles into a selected detent dimple 24*a*.

As understood by skilled persons, the detent mechanism 38 illustrated in FIGS. 5A and 5B, may also (with little or no modification) act as a locking means. That is, once an operator has set the desired angle of the steerable wheel 26, the detent threaded plug 38*c* (set screw) may be screwed further into a threaded portion of the bore 39, until the spring 38*b* is fully compressed (not illustrated), thereby firmly holding the detent pin 38*a* in position, engaging a respective detent dimple 24*a*. When the operator again would like to alter the angle of the steerable wheel 26, the detent threaded plug 38*c* may be partially backed out of the bore 39, until the detent mechanism 38 is again set to enable detent-based rotation of the grasping portion, or alternately enable 'freehand' rotation.

When operating the wheeled guide assembly 10*a* as illustrated in FIGS. 2A through 5B, the cut providing tool 70 may be employed for making cuts in a surface 90, up to the point where an obstruction is encountered. For example, when considering the structure of the steerable wheel assembly 20, as clearly seen in FIGS. 4A through 5B, the cutting of a surface can continue until a portion of the steerable wheel assembly 20 reaches and contacts the obstruction. At this point the actual cutting portion of a cutting member 76 may still be a substantial distance, say 3 to 8 inches, from the edge of the obstruction. Although this uncut distance may be reduced, as will be discussed hereinafter, in most cases it cannot be eliminated. For example, consider the depiction of FIG. 3, at the right edge of the surface 90 is an exemplary obstruction—a house wall 92.

Figure 6A:
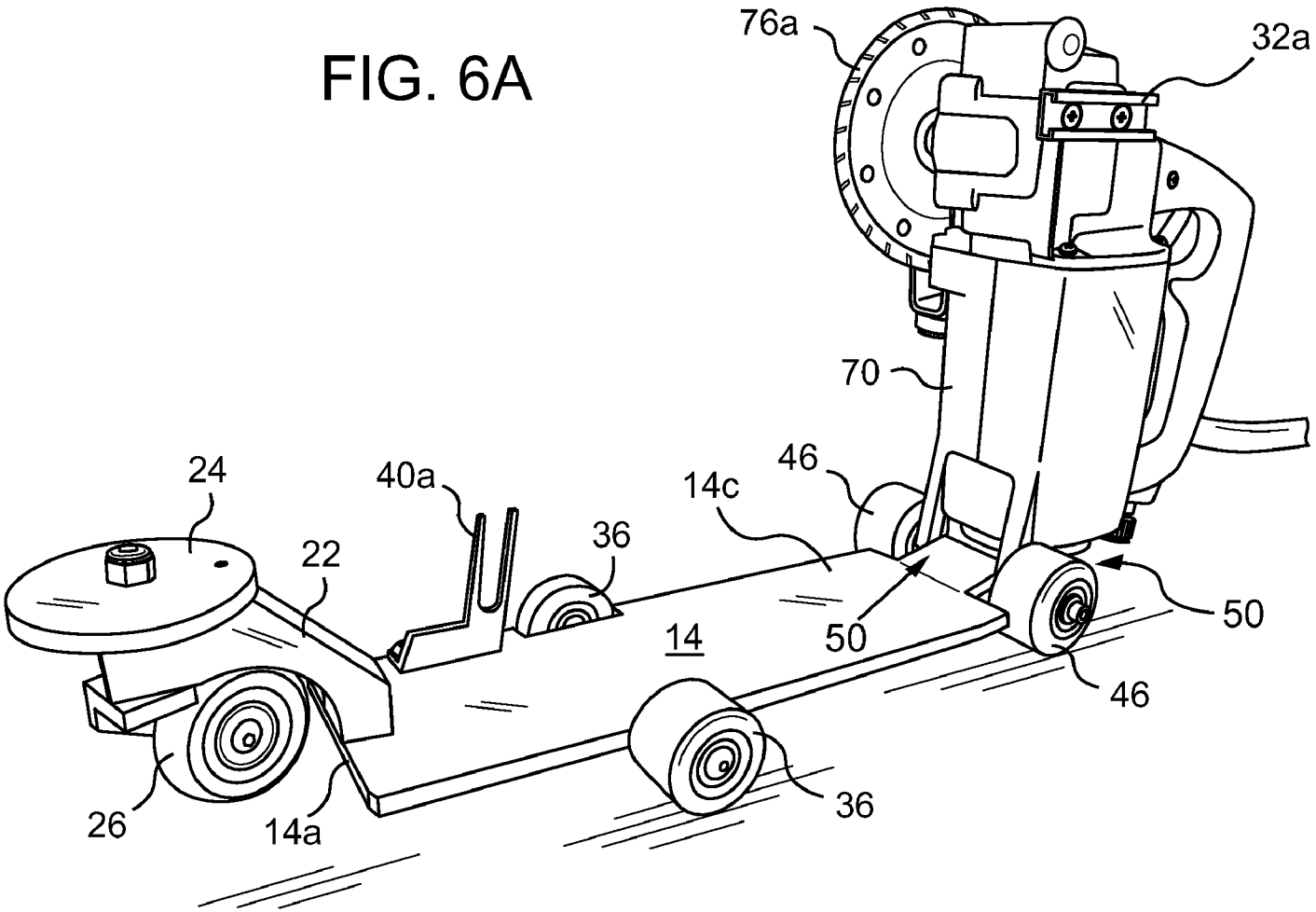
FIG. 6A illustrates a cut providing tool, which is rotatably coupled to a wheeled guide assembly, rotated approximately 90 degrees about the rotatable coupling.

Turning to FIGS. 6A and 6B, a preferred rotatable coupling 50 is depicted at the second end 14*c* of the base portion 14. An included slidable coupling 40, which includes a u-shaped slide portion 40*a*, and a slide lock level 40*c* (and associated structures), provides for a releasing of the adjustable slidable coupling 40, as clearly shown in FIG. 2B. As shown in FIGS. 6A and 6B, the rotatable coupling 50 may be provided by a simple hinge arrangement, possibly including an integral rotational shaft or axle (not explicitly illustrated), which may also be an axle of the fixed wheels 46. Importantly, the rotatable coupling 50 enables the base portion 14, upon a releasing of the adjustable slidable coupling 40, to be selectively rotated an additional 270 degrees about the rotatable coupling 50. Once fully rotated, as clearly seen in FIG. 6B, the base portion 14 is positioned substantially behind the cut providing tool 70. When rotated as shown in FIG. 6B, the base portion 14 and the attached steerable wheel assembly 20, are each secured in what may be termed an out-of-the-way 'stowed position'. With the base portion 14 in the stowed position, a cut providing tool 70 is generally able to effect a substantially closer cut when approaching and cutting up to an obstruction.

However, once the base portion 14 of the wheeled guide assembly 10/10*a* is in the stowed position of FIG. 6B, providing a consistent depth of cut is quite difficult as there is no form of rolling or supporting structure remaining up front proximate to the cutting member 76. This can be seen in FIG. 6A, when considering only the cut providing tool 70, with the base portion 14 removed. Accordingly, to aid in providing the needed additional control at the front of the cut providing tool 70 when the base portion 14 is in the stowed position, a drop wheel assembly 30 may included with the wheeled guide assembly 10/10*a*. The drop wheel assembly 30 is preferably coupled to a structure of the cut providing tool, so as to be positioned proximate to a cutting member, and at an end opposite to the end with the rotatable coupling 50 and the fixed wheels 46. As best seen in the expanded view of FIG. 6C, the drop wheel assembly 30 may actually most preferably be coupled directly to the housing 70-1 of the cut providing tool 70, alternately coupled by way of a providable support that may be fixed to the housing.

One possibly most preferred drop wheel assembly 30 may be structured to include a T-channel portion 32*a*, which is substantially vertically oriented, and as illustrated in FIGS. 6A, 6B, and 6C, may be directly screw mounted to the cut providing tool 70 proximate to the cutting member 76. Also included is a T-bar member 32*b* sized and structured for inserting into, and being slidably coupled within, the T-channel portion 32*a*, as shown in FIGS. 2B, 6B, and 6C. This slidable coupling arrangement, and many others that are functionally equivalent, enables a vertical position of the T-bar member 32*b* to be adjusted, as needed, for a desired depth of cut. As illustrated, and possibly best seen in FIG. 6C, at least one drop wheel 34 is rollably fixed to a lower end of the T-bar member 32*b*. As such, the T-bar member 32*b* and drop wheel 34 may be adjusted, and subsequently locked at a selected vertical position. Many locking means are possible to secure the T-bar member 32*b* and drop wheel 34 at an operator selected position. For example, a preferred and basic locking means, as depicted in FIGS. 2B, 6B, and 6C, is providable with a locking screw knob 32*c*, which is employed with a treaded through hole provided in the T-bar member 32*b*. As understood by skilled persons, once threaded into the hole, an end portion of a threaded locking screw knob 32*c* may pass out a back side of the T-bar member 32*b* for engaging a surface of the T-channel portion 32*a*, and locking the T-bar member 32*b* within the T-channel portion. Clearly this structure, as well as others that are providable, will enable an operator to place the drop wheel 34 at a selected vertical position, and locked at that position by hand turning a knob fixed to an end of the threaded locking screw knob 32*c*.

Therefore, once the base portion 14 and steerable wheel assembly 20 are in the stowed position, and the drop wheel 34 is properly set at the selected vertical (height) position, an operator may make or complete one or more controlled cuts. Importantly, the use of the drop wheel assembly 30 (of FIG. 6C) enables the operator to cut much closer to the obstruction while rolling upon the drop wheel 34 and the fixed wheels 46, than would be possible rolling upon the pivot wheels 36 of the wheeled guide assembly 10/10*a*.

Returning to FIGS. 1 and 6B, a latching mechanism 48 may be included with most preferred embodiments of the wheeled guide assembly 10/10*a*, and particularly with embodiments including the drop wheel assembly 30. As illustrated, the latching mechanism 48 may include a first latching portion 48*a* and a second latching portion 48*b*. As depicted the first latching portion 48*a* may be fixed to the rear facing portion or surface of the operator handle 74. As seen first in FIG. 1, and clearly implied in FIG. 6B, the second latching portion 48*b* is fixed to a bottom of the base portion 14 and aligned such that when the base portion 14 is rotated substantially 270 degrees and placed in the stowed position, the first latching portion 48*a* and second latching portion 48*b* engage and hold. In a most preferred embodiment of the invention, the first latching portion 48*a* is provided by a high flux magnet, such as a cobalt magnet, and the second latching portion 48*b* would be a fixed and aligned disk that is either attracted to magnetic material, or is itself magnetic.

Figure 7:
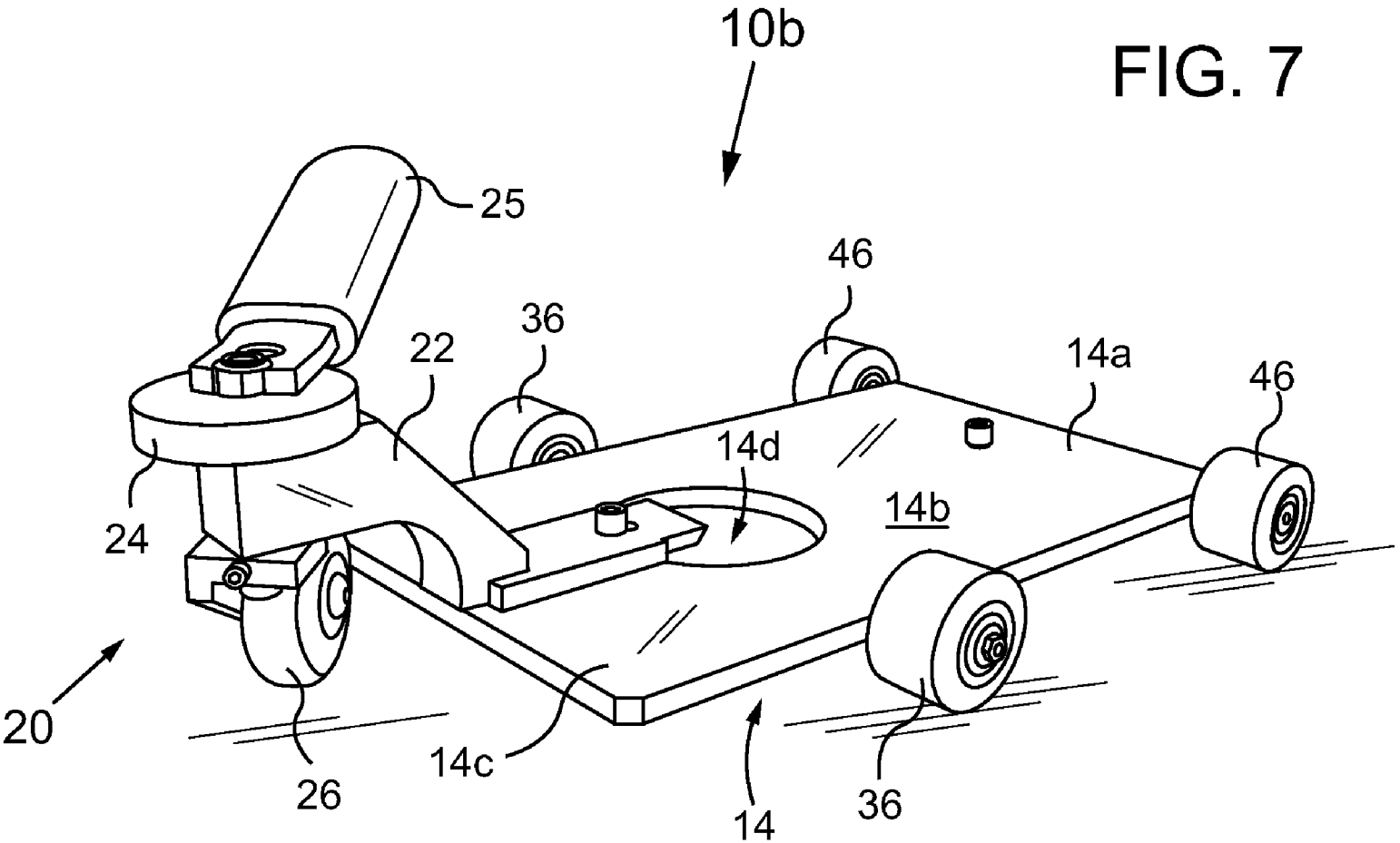
FIG. 7 provides a perspective rear-side view of one possible alternate embodiment of a wheeled guide assembly of the invention, which as shown is configured with differing features such as a centered hole for passage of a cutting member of a cut providing tool, and a modified steerable wheel assembly that is mounted at a rear end location of the wheeled guide assembly (as opposed to a front end location mounting).

While there have been described herein a plurality of the currently preferred embodiments of the means and methods of the present invention, those skilled in the art will recognize that other and further modifications may be made without departing from the invention. For example, when considering a wheeled guide assembly for use with reciprocating saws, such as jig and saber saws, a preferred embodiment may be modified and or include additional structures. As illustrated in FIG. 7, alternate embodiments may include a center hole 14*d* or an off-center or elongated hole/opening (not illustrated). In addition, a steerable wheel 26 may be controlled with a large steering handle, which may or may not include detent and locking means. Clearly the embodiment of the wheeled guide assembly 10*b*, may employ alternate coupling means to hold a cut providing tool 70 to the base portion 14. Also, as clearly indicated in FIG. 7, the steerable wheel 26 and fixed wheels 46 may be placed at the second end 14*c* and first end 14*a*, respectively, of the base portion 14. Thus the embodiment of FIG. 7 may be employed with a 'rear steering' steerable wheel 26.

In addition, the present wheeled guide assembly of the invention may also be adapted for other not-cutting uses. For example, the wheeled guide assembly may be modified for use with marker devices and pens. This need may arise when one or more lines, possibly in a pattern or design, must be transferred to a surface as a plurality of guide lines, for use in subsequently making a plurality of required decorative cuts. A skilled person may want to carefully mark the locations of all needed cuts—before any cutting commences.

As such, the foregoing descriptions of the specific embodiments of the present invention have been provided for the purposes of illustration, description, and enablement. They are not intended to be exhaustive or to limit the invention to the specific forms disclosed and or illustrated. Obviously numerous modifications and alterations are possible in light of the above teachings, and it is fully intended to claim all modifications and variations that fall within the scope of the appended claims provided hereinafter.

What is claimed is:

1. A wheeled guide assembly for use with cut providing tools, comprising:

a) a base portion having a first end and a second end, and rockable between either of a first position, enabling substantially straight-line cuts, and a second position, enabling controlled curved-line cuts;

b) a plurality of rollably coupled wheels, including:

i) at least two pivot wheels axially aligned and mounted on opposite sides of the base portion, at a selected location between the first end and the second end of the base portion;

ii) at least one fixed wheel coupled to one of the first end or the second end of the base portion; and iii) at least one steerable wheel that is rotatably coupled to the base portion at an end opposite to the fixed wheels and structured to enable an operator to rotate the steerable wheel about a vertical axis, for making operator controlled curved-line cuts;

c) with the base portion structured for coupling to a cut providing tool and rockable into either the first position or the second position, wherein:

i) when in the first position the wheeled guide assembly rolls upon the pivot wheels and the fixed wheels encouraging a substantially straight-line motion, and thereby enabling substantially straight-line cuts to be made with the cut providing tool; and ii) when in the second position the wheeled guide assembly rolls upon the pivot wheels and the at least one steerable wheel supporting a non-linear motion, which is controllable by an operator, for selectively providing non-linear curved-line cuts.

2. The wheeled guide assembly in accordance with claim 1, wherein a horizontal rolling axle of the pivot wheels is vertically aligned with at least one of:

a) a rotational axis of a rotating cutting member of the cut providing tool; and b) a vertical cutting axis of a cutting member;

c) with the vertical aligning enabling controlled curved-line cuts having a minimized additional cut width.

3. The wheeled guide assembly in accordance with claim 2, wherein the cut providing tool is a circular saw, coupled to the base portion with a horizontally oriented rotating shaft of a motor of the circular saw vertically aligned with and above the axle of the pivot wheels.

4. The wheeled guide assembly in accordance with claim 3, wherein the base portion is provided by a substantially flattened plate structure, with a single steerable wheel coupled to the base portion by way of a support member, with the support member fixed at a second end of the base portion, which is opposite to the end wherein the fixed wheels are coupled.

5. The wheeled guide assembly in accordance with claim 4, further including a steering mechanism structured having:

a) the support member coupled to the second end of the base portion and extended outwardly therefrom;

b) a vertically oriented steering shaft that is rotatably mounted to a distal end of the support member such that the steering shaft may be rotated about a vertical longitudinal axis of the steering shaft;

c) a wheel support, with the steerable wheel rollably fixed to the wheel support, and with the wheel support further fixedly coupled to an end of the steering shaft, so that when the steering shaft is rotated about the vertical longitudinal axis thereof, the wheel support is rotated and the angle of the steerable wheel is altered accordingly; and d) an operator grasping portion fixedly coupled to an end opposite to the end wherein the wheel support portion is coupled;

e) with the steering mechanism structured such that an operator may grasp and operate the grasping portion to rotatably alter the angle and the rolling direction of the steerable wheel, and thereby alter a curvature of curved-line cuts.

6. The wheeled guide assembly in accordance with claim 5, wherein the steering mechanism further includes a means for maintaining an operator selected angular setting of the steerable wheel.

7. The wheeled guide assembly in accordance with claim 1, wherein the base portion is rotatably coupled to a selected end of the cut providing tool, such that the base portion may be rotated substantially 270 degrees about an axis of the rotatable coupling so as to position the base portion substantially behind the cut providing tool, where the base portion and attached steering mechanism is securable in an out-of-the-way stowed position, enabling a cut providing tool coupled to the base portion to make a substantially closer cut when approaching an obstruction.

8. The wheeled guide assembly in accordance with claim 7, further including a drop wheel assembly that is fixable to an end of the cut providing tool opposite to the end that is rotatably coupled to the base portion, with the drop wheel assembly comprising:

a) a T-channel portion substantially vertically fixed to the cut providing tool proximate to the cutting member of the cut providing tool;

b) a T-bar member sized and structured to be inserted into, and slidably coupled within the T-channel portion enabling the vertical position of the T-bar member to be adjusted;

c) at least one drop wheel, rollably fixed to a lower first end of the T-bar member; and d) locking means structured to secure the T-bar member at a selected vertical position, such that the at least one drop wheel is employable in aiding an operator in making cuts that are providable much closer to the obstruction than would be possible rolling upon the pivot wheels.

9. The wheeled guide assembly in accordance with claim 7, further including a latching mechanism having portions coupled to a bottom of the base portion and a rear facing surface of the cut providing tool, and included for maintaining the base portion in the stowed position.

10. A wheeled guide assembly for use under and as a rollable support carrier of a cut providing tool, for enabling the cut providing tool to be employed for making one or more cuts upon a selected hard surface, the guide assembly comprising:

a) a base portion provided as a rigid and flattened plate structure, with the base portion having a first end and a second end, and structured for having a cut providing tool coupled thereupon;

b) with the base portion further structured for rocking between one of a straight-rolling first rolling position and a selectively curved-rolling second position;

c) a first plurality of axially aligned, spaced, and rollable pivot wheels, which are axially aligned and rollably coupled to opposite sides of the base portion at a location substantially between the first end and the second end;

d) a second plurality of axially aligned fixed wheels that are axially aligned and rollably coupled to the base portion at one of the first end and the second end;

e) a steerable wheel assembly coupled to the base portion at an end opposite to the end that the fixed wheels are coupled, with the steerable wheel assembly including a rotatably mounted and steerable wheel;

f) with the steerable wheel arranged for engaging and rolling upon a surface being cut for enabling an operator to selectively alter an angle between a longitudinal axis of the base portion and the rolling direction of the wheeled guide assembly;

g) with the pivot wheels axially coupled to the base portion such that a rolling surface of the pivot wheels extends below and at least partially through a plane established by considering only a plurality of rolling surfaces of the fixed wheels and the steerable wheel, and thereby structured for being rocked into either one of:

i) a first rolling position selectable by an operator such that the guide assembly rolls upon the pivot wheels and the fixed wheels encouraging a substantially linear rolling motion, thereby enabling a cut providing tool coupled to the guide assembly to provide straight cuts; and ii) a second rolling position selectable by an operator such that the guide assembly rolls upon the pivot wheels and the steerable wheel, thereby enabling a cut providing tool coupled to the guide assembly to provide curved, non-linear cuts; and h) with an axle of the pivot wheels structured positioned so as to be substantially vertically aligned with a rotational cutting axis of the cut providing tool.

11. The wheeled guide assembly in accordance with claim 10, wherein the vertical alignment is between the axially aligned pivot wheels and one of:

a) a rotational center of a disk shaped cutting blade of the cut providing tool;

b) a vertical axis of a reciprocating rectilinear elongated saw blade; and c) a vertical rotational axis of a routing bit.

12. The wheeled guide assembly in accordance with claim 11, wherein the base portion is rotatably coupled to a selected end of the cut providing tool, such that the base portion may be rotated substantially 270 degrees about the rotatable coupling so as to position the base portion substantially behind the cut providing tool, and securable in an out-of-the-way stowed position, enabling a cut providing tool coupled to the base portion to make a substantially closer cut to an obstruction.

13. The wheeled guide assembly in accordance with claim 12, further including a drop wheel assembly, comprising:

a) a T-channel portion substantially vertically fixed to the cut providing tool proximate to the cutting member of the cut providing tool;

b) a T-bar member sized and structured to be inserted into, and slidably coupled to the T-channel portion enabling the vertical position of the T-bar member to be adjusted;

c) at least one drop wheel, rollably fixed to the T-bar member for contacting a surface being cut, such that the front end of the wheeled guide assembly is supported upon the drop wheel;

d) a threaded locking bolt member structured to secure the T-bar member at a selected vertical position, such that the at least one drop wheel is employable in aiding an operator in making cuts that are providable much closer to the obstruction than would be possible rolling upon the pivot wheels.

14. The wheeled guide assembly in accordance with claim 13, further including a latching mechanism having portions coupled to a bottom of the base portion and a rear facing surface of the cut providing tool.

15. The wheeled guide assembly in accordance with claim 14, wherein the latching mechanism includes at least one magnet fixed to at least one of:

a) a rear location of the cut providing tool; and b) the bottom of the base portion.

16. A wheeled cut providing tool structured to selectively provide straight-line cuts and curved-line cuts, as required, the wheeled cut providing tool comprising:

a) a cut providing tool structured having a housing containing a motor with a rotating shaft of the motor coupled to drive a cutting member of the cut providing tool;

b) a substantially flattened base portion having a first end and a second end, with the cut providing tool fixedly coupled to the base portion;

c) a plurality of rollably mounted, fixed orientation wheels that are coupled to the base portion, including:

i) a plurality of pivot wheels axially mounted to the base portion at a selected location between the first end and the second end of the base portion, with the pivot wheels having an outer wheel surface extending a pre-determined distance below a plate portion of the base portion; and ii) a plurality of fixed wheels, axially mounted to the base portion proximate to an end of the base portion; and d) a steerable wheel assembly fixedly coupled to the base portion at an end opposite to the fixed wheels, and structured having a rotatably mounted steerable wheel provided for selectively altering an angle between a longitudinal axis of the base portion and the rolling direction of the steerable wheel;

e) with the fixed wheels and the steerable wheels, each having an outer wheel surface establishing a plane, wherein the outer wheel surface of the pivot wheels, which extend the pre-determined distance below a plate portion of the base portion, also extend through the plane established by the fixed and steerable wheel surfaces, such that the wheeled cut providing tool is rockable into either a first position or a second position, wherein:

i) when in the first position the wheeled cut providing tool rolls upon the pivot wheels and the fixed wheels encouraging a substantially straight-line motion, and thereby encouraging a substantially straight-line cutting by the cut providing tool; and ii) when rocked in the second position the wheeled cut providing tool rolls upon the pivot wheels and the steerable wheel supporting a non-linear motion, which is controllable by an operator, thereby enabling a substantially non-linear motion, and thereby enabling a substantially non-linear cutting by the cut providing tool.

17. The wheeled cut providing tool in accordance with claim 16, wherein a horizontal axle of the pivot wheels is in vertical alignment, and positioned below at least one of:

a) a horizontal rotational axis of a vertically oriented cutting member; and b) a rotational axis of a cutting blade, such that the axle of the pivot wheels and the rotational axis of the cutting blade are in spaced parallel relationship and vertically offset a fixed vertical distance;

c) with the vertical alignment of axle of the pivot wheels and a rotating axis of the cutting member enabling controlled-depth curved-line cuts having a minimized additional cut width.

18. The wheeled cut providing tool in accordance with claim 17, wherein the cut providing tool is a circular saw, coupled to the base portion with the rotating shaft of a motor of the circular saw spaced and vertically aligned above the axle of the pivot wheels.

19. The wheeled cut providing tool in accordance with claim 16, wherein the base portion is rotatably coupled to a selected end of the cut providing tool, such that the base portion may be rotated substantially 270 degrees about the rotatable coupling so as to position the base portion substantially behind the cut providing tool, where the base portion and attached steering mechanism are securable in an out-of-the-way stowed position, enabling a cut providing tool coupled to the base portion to make a substantially closer cuts when approaching an obstruction.

20. The wheeled cut providing tool in accordance with claim 16, wherein the steerable wheel assembly includes:

a) a support member coupled to a second end of the base portion and extended outwardly therefrom;

b) a vertically oriented steering shaft that is rotatably mounted to a distal end of the support member such that the steering shaft may be rotated about a vertical longitudinal axis of the steering shaft;

c) a wheel support portion, with the steerable wheel rollably coupled to the wheel support portion, while the wheel support portion is further coupled to a lower end of the steering shaft, such that when the steering shaft is rotated about the vertical longitudinally axis, the rolling direction of the steerable wheel is altered; and d) an operator grasping portion fixedly coupled to an upper end of the steering shaft;

e) with the steering mechanism structured such that an operator may grasp the operator grasping portion to rotatably alter a selected steerable wheel angular setting, and thereby alter the curvature of a curved-line cut, even while the curved-line cut is being made.

* * * * *